US008205683B2

(12) United States Patent
Schadow et al.

(10) Patent No.: US 8,205,683 B2
(45) Date of Patent: Jun. 26, 2012

(54) HAND-HELD POWER TOOL, IN PARTICULAR ELECTRICALLY DRIVEN HAND-HELD POWER TOOL

(75) Inventors: Joachim Schadow, Stuttgart (DE); Joerg Maute, Sindelfingen (DE)

(73) Assignee: Robert Bosch GmbH, Stuttgart (DE)

( * ) Notice: Subject to any disclaimer, the term of this patent is extended or adjusted under 35 U.S.C. 154(b) by 62 days.

(21) Appl. No.: 12/669,516

(22) PCT Filed: Nov. 11, 2008

(86) PCT No.: PCT/EP2008/065308

§ 371 (c)(1), (2), (4) Date: Jan. 18, 2010

(87) PCT Pub. No.: WO2009/092468

PCT Pub. Date: Jul. 30, 2009

(65) Prior Publication Data

US 2010/0193209 A1 Aug. 5, 2010

(30) Foreign Application Priority Data

Jan. 25, 2008 (DE) ..... 10 2008 006 030

(51) Int. Cl.
*B25D 17/24* (2006.01)

(52) U.S. Cl. ..... 173/162.2; 173/162.1

(58) Field of Classification Search ..... 173/162.1, 173/162.2; 267/136; 451/357
See application file for complete search history.

(56) References Cited

U.S. PATENT DOCUMENTS

| | | | | |
|---|---|---|---|---|
| 4,800,965 | A * | 1/1989 | Keller | 173/162.2 |
| 4,907,772 | A | 3/1990 | Honsa et al. | |
| 5,157,807 | A | 10/1992 | Keller et al. | |
| 5,394,039 | A * | 2/1995 | Suchdev et al. | 310/51 |
| 5,813,477 | A * | 9/1998 | Clay et al. | 173/1 |
| 6,076,616 | A * | 6/2000 | Kramp et al. | 173/162.2 |
| 6,268,038 | B1 * | 7/2001 | Porte et al. | 428/116 |
| 7,152,695 | B2 * | 12/2006 | Happ et al. | 173/217 |
| 2007/0034397 | A1 * | 2/2007 | Fischer et al. | 173/162.2 |
| 2008/0153401 | A1 | 6/2008 | Wuensch et al. | |
| 2008/0190259 | A1 | 8/2008 | Bohne | |

FOREIGN PATENT DOCUMENTS

| | | |
|---|---|---|
| CN | 1 419 062 | 5/2003 |
| DE | 40 11 124 | 10/1991 |
| DE | 10 2004 050 798 | 4/2006 |
| DE | 10 2005 061 870 | 7/2007 |
| DE | 10 2007 027 489 | 12/2007 |

* cited by examiner

*Primary Examiner* — Rinaldi Rada
*Assistant Examiner* — Nathaniel Chukwurah
(74) *Attorney, Agent, or Firm* — Michael J. Striker

(57) ABSTRACT

A handheld power tool has a housing having two separate housing parts, between which a primary damping element is disposed, wherein a secondary damping element is disposed acting parallel to said primary damping element. During regular function of the primary damping element, the secondary damping element is at least approximately force-free. In the event of a changed relative position between the two housing parts, the damping occurs via the secondary damping element.

12 Claims, 6 Drawing Sheets

HAND-HELD POWER TOOL, IN PARTICULAR ELECTRICALLY DRIVEN HAND-HELD POWER TOOL

Figure 1:
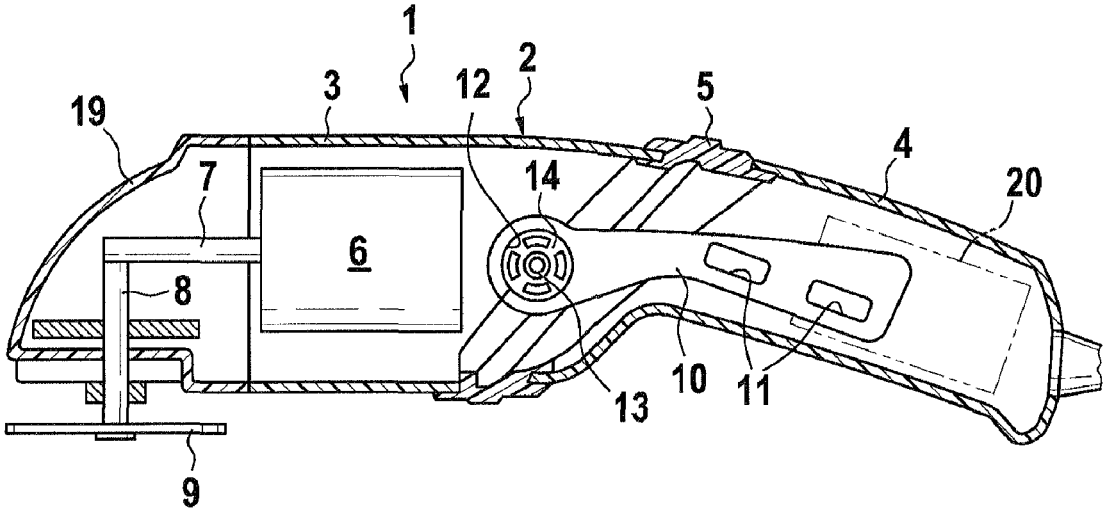

The present invention relates to a hand-held power tool, in particular an electrically driven hand-held power tool, according to the preamble of claim 1.

BACKGROUND INFORMATION

DE 10 2004 050 798 A1 describes a hand-held power tool which includes a drive shaft that is driveable in an oscillating manner, and to which a tool may be detachably fastened. An electric motor is used as the drive motor, the motor shaft of which drives an eccentric disk that actuates a transfer level which is non-rotatably connected to the drive shaft, in order to convert the rotational motion of the eccentric disk to the oscillating motion of the drive shaft.

The oscillating driving action produces vibrations that contribute to noise development and, in particular, are a source of mechanical stress on the components of the hand-held power tool. The aim, therefore, is to reduce vibrations by implementing suitable measures such as using damping elements. It should be ensured that the damping measures remain effective for long periods of operation.

DISCLOSURE OF THE INVENTION

The object of the present invention is to effectively reduce vibrations in a hand-held power tool for a long period of operation using simple measures.

This object is achieved according to the present invention having the features of claim 1. The dependent claims describe expedient developments.

The hand-held power tool according to the present invention, which is an electrically driven hand-held power tool in particular, e.g., an angle grinder, includes a drive unit which is located in a housing and drives a tool via a drive connection. The housing of the hand-held power tool has a two-component design and includes two separate housing parts, between which a primary damping element is situated and contributes to effective vibration damping and/or reduction between the housing parts and, therefore, in the entire hand-held power tool. The drive unit and the drive shaft on which the tool is mounted are typically located in the front housing part, while the rear housing part is designed as a handle shell in which the electronics are accommodated and on which operating switches are located. The primary damping element dampens vibrations that originate in the drive unit, and vibrations generated via operation of the tool. In particular, the primary damping element reduces vibrations generated by the eccentric drive, such as out-of-balance oscillations, but also vibrations in the power tool. The vibratory stress that acts on a handle in the rear housing part is reduced considerably. The primary damping element also performs a force-transferring function and holds the two housing parts against one another.

To ensure that vibrations are effectively damped even if the damping element fails or becomes impaired, a secondary damping element that acts in parallel with the primary damping element is located between the two housing parts of the hand-held power tool. During regular functioning of the primary damping element, this secondary damping element is at least approximately force-free, and becomes operational only if the primary damping element becomes deformed beyond a defined extent. If a deformation of this type occurs, the relative position between the two housing parts changes accordingly, thereby activating the secondary damping element and allowing its damping effect to unfold. A stepped, hierarchical mode of operation is attained in this manner: When the primary damping element is intact and/or when the loads on the hand-held power tool are below a threshold value, damping is performed exclusively or at least nearly exclusively by the primary damping element. However, if the primary damping element begins to lose functionality, e.g., due to material ageing, or if the damping element fails, or if extremely high forces occur, e.g., due to impacts generated externally, thereby causing the relative position between the two housing parts to change beyond a normal extent, then the secondary damping element becomes active. In this manner it is ensured that vibration damping remains effective for a long operating period of the hand-held power tool. The potential operating period is increased overall since vibrations are initially damped by the primary damping element while it is intact, and the secondary damping element is not subjected to stress during this period. The secondary damping element is therefore not subject to ageing, or it only ages in a delayed manner, and it may unfold its functionality if the primary damping element fails.

According to an advantageous embodiment, the secondary damping element interacts with a securing element that bridges the two housing parts. The securing element may be formed, in particular, such that it is even possible to transfer high forces between the housing parts. At the same time, the secondary damping element effectively reduces vibrations on the securing part if the functionality of the primary damping element fails or drops off. The securing part and the secondary damping element may therefore be optimized in terms of their different tasks. It is possible, for example, to use soft materials as the second damping elements, which are not used to transfer force, but rather only to dampen vibrations, while the securing part does not dampen vibrations, but is used to transfer force.

According to a further advantageous embodiment, the securing element is fixedly connected to one housing part, and it is loosely connected to the other housing part, in particular via the secondary damping element. This takes place, e.g., by installing a bolt-receptacle-connecting device in the region of the loose connection, in which a bolt, e.g., on the housing part, engages in a receptacle in the securing part, and in which the secondary damping element at least partially encloses the bolt, e.g., in an embodiment as a damping ring that is retained in the receptacle or on the bolt. The bolt extends loosely into the receptacle and is connected to the receptacle only via the secondary damping element. In terms of the loose connection between the securing part and the housing part, a configuration is possible in which play exists between the secondary damping element and the affected component of the connection device, and in which there is bearing with contact, but without force being transferred during regular operation. Via the loose connection between the securing part and the damping element and the associated housing part it is ensured that the secondary damping element does not become effective unless the primary damping element fails or unless the housing parts become displaced relative to one another to an extreme extent.

According to a preferred embodiment, the secondary damping element is designed as a standalone component which is located and/or retained on the securing element, possibly even on one of the housing parts. According to an alternative advantageous embodiment, the secondary damping element is integrated in the securing element. In this case, it is possible to incorporate the secondary damping element, which is designed as a standalone component, in the securing part, and to design the secondary damping part as a single piece with the securing element, in particular in the form of a special structural design of the securing part. In the latter case, securing parts include, e.g., a section shaped as a wave or bellows; this section forms the secondary damping element which may expand or contract longitudinally in response to an application of force, and damping is performed via the inherent damping properties of the material of which the securing part is composed.

If the secondary damping element is designed as a standalone component, it may be composed of known damping materials such as elastomers, thermoplasts, duroplasts, TPE, or other plastics. It may also be designed as a weave composed, e.g., of metal, plastic, or other materials, it also being possible to use weaves of different pairs of materials. Finally, it is also possible to use fluid or semi-fluid or viscous media such as silicone, gel, grease, or oil. Gaseous media may also be used for the secondary damping element. Fluid or gaseous media have the advantage that the damping properties may be easily influenced or adjusted via the pressure of the fluid or via the selection of the viscosity of the fluid.

When the secondary damping element, which is designed as a standalone component, is integrated in the material of the securing part, possible embodiments include a wire cable, carbon fiber, coiled spring, or the like. It is integrated in the securing part either by subsequently attaching the secondary damping element to the securing part, e.g., by clamping it in recesses or onto projections of the securing part, or by fastening it using common fastening techniques, or even during production of the securing part, e.g., by enclosing it in a coating of the material of which the securing part is composed, or of another material. For this purpose, the secondary damping element is embedded, e.g., as an insertion part, in the shaping tool of the securing part. It is also possible to apply the coating after the securing part has been produced, in which case a connection to the securing part is attained via the injection molding procedure.

According to a further advantageous combination of securing part and secondary damping element, the securing part is designed as a wire cable, and the secondary damping element is designed as a tube drawn over the wire cable. The tube has the desired damping properties, while the wire cable is suitable for transferring force. At the same time, the combination of securing part and secondary damping element is deformable in design, and may therefore be adapted to various geometries in the hand-held power tool. It is also basically possible, however, to provide an inherently stiff secondary damping element that nevertheless has damping properties due to its geometry and/or material.

Further advantages and expedient embodiments are depicted in the further claims, the description of the figures, and the drawings.

Figure 2:
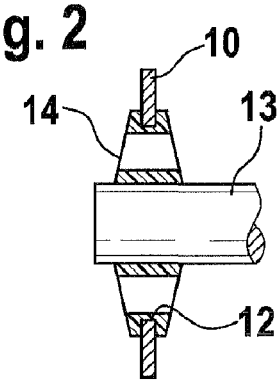
Figure 3:
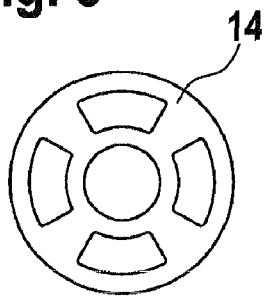
Figure 4:
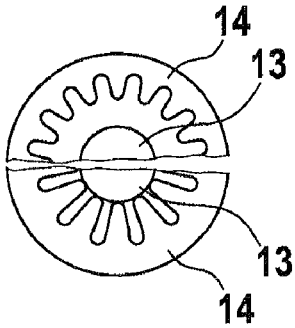
Figure 5:
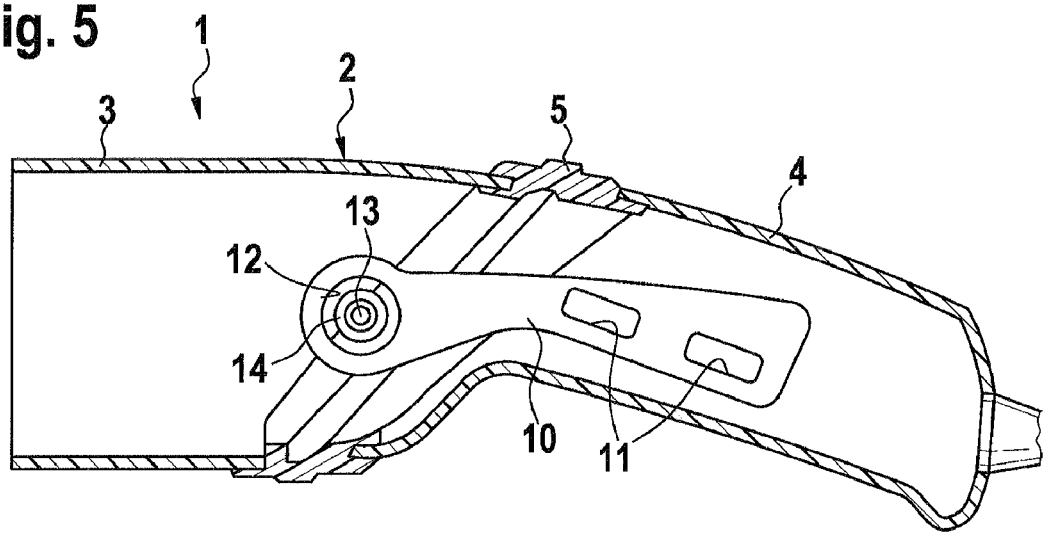
Figure 6:
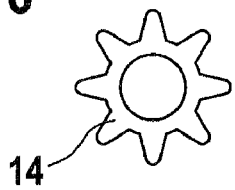
Figure 7:
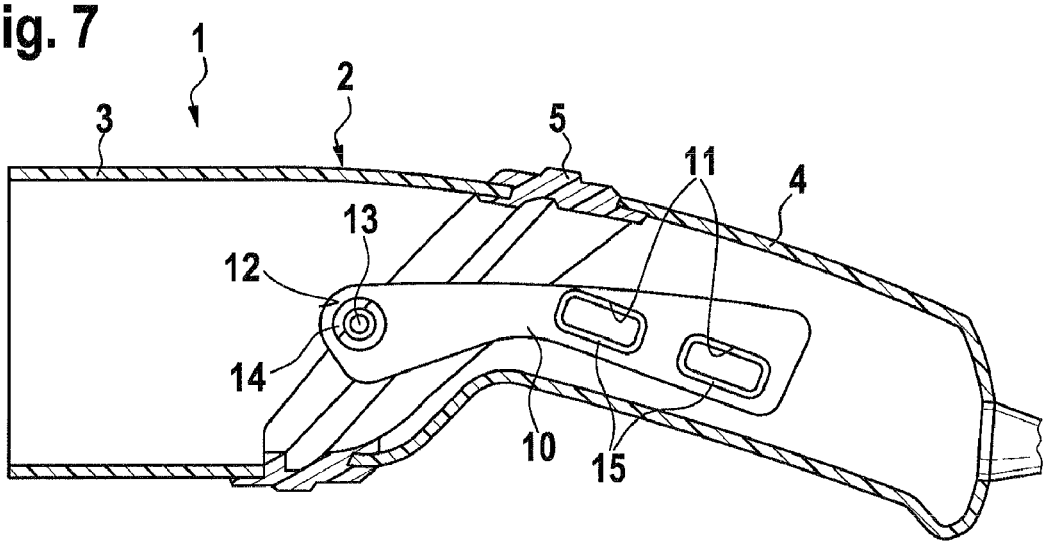
Figure 8:
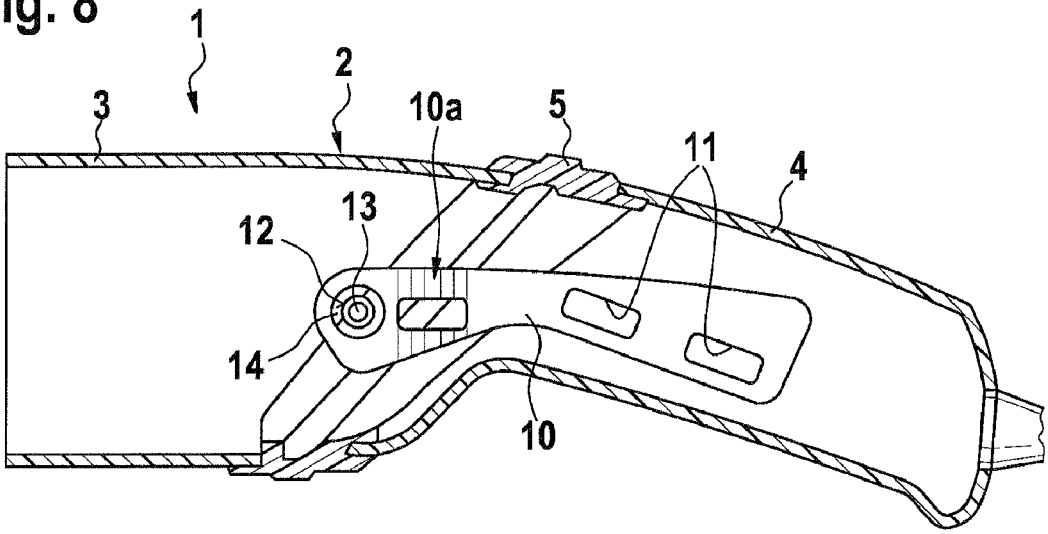
Figure 9:
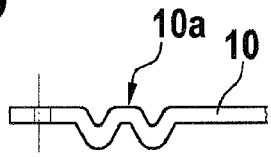
Figure 10:
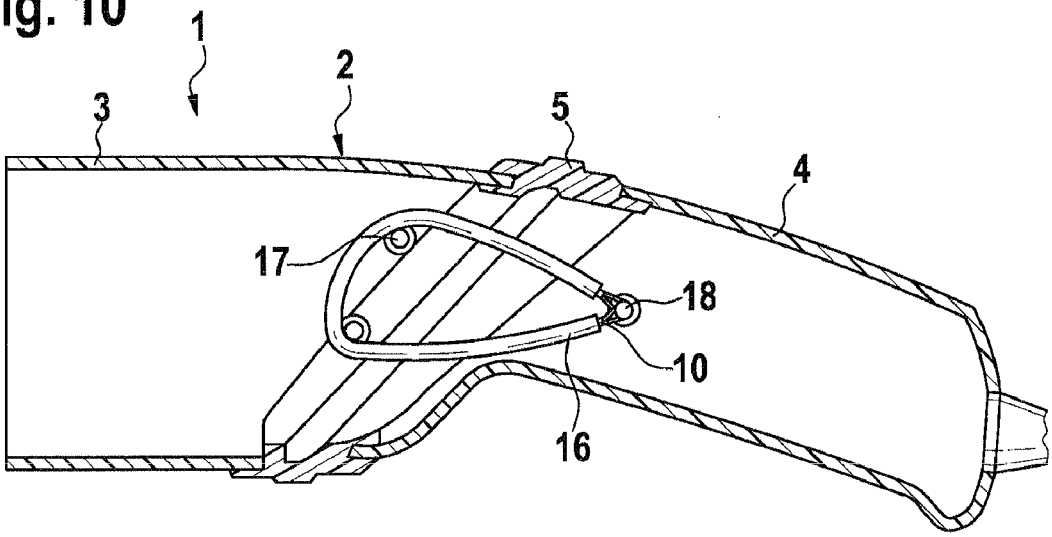
Figure 11:
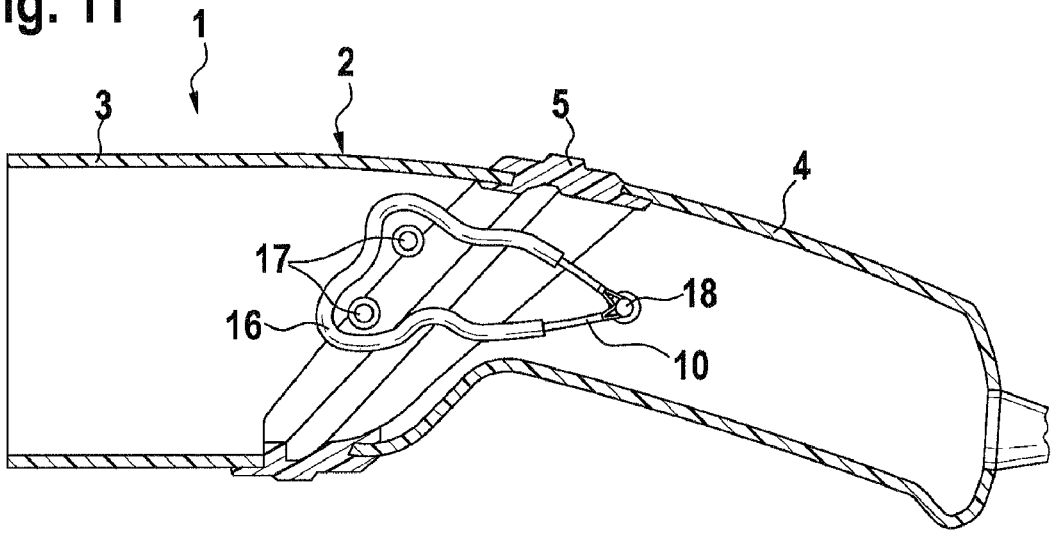

FIG. 1 shows a sectional view of a hand-held power tool including a two-pieced housing, in the case of which the two housing parts are interconnected via a primary damping element, and in which a securing part including a secondary damping element that functions in parallel with the primary damping element is provided, FIG. 2 shows isolated views of the connection device between the securing part, including the secondary damping element and the front housing part, FIG. 3 shows a top view of the secondary damping element depicted in FIG. 2, FIG. 4 shows a further embodiment of a secondary damping element, FIG. 5 shows a hand-held power tool including a securing part and a secondary element, in a further embodiment, FIG. 6 shows a further embodiment of a secondary damping element, FIG. 7 shows a hand-held power tool including a securing part and secondary damping elements enclosed in foam, for connection to the rear housing part, FIG. 8 shows a hand-held power tool including a securing part that has a section having a damping geometry, FIG. 9 shows the section having a damping geometry in the securing part, in an isolated view, FIG. 10 shows a hand-held power tool including a securing part designed as a wire cable over which a tube has been drawn, the tube performing the function of a damping element, FIG. 11 shows an embodiment similar to that depicted in FIG. 10, but including a shaping tube over the wire cable.

Figure 12:
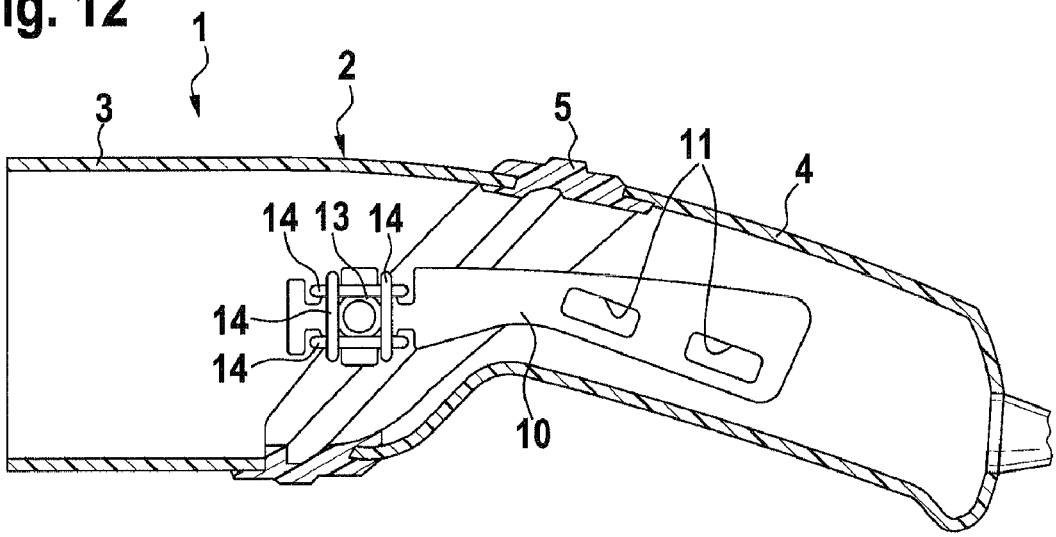
Figure 13:
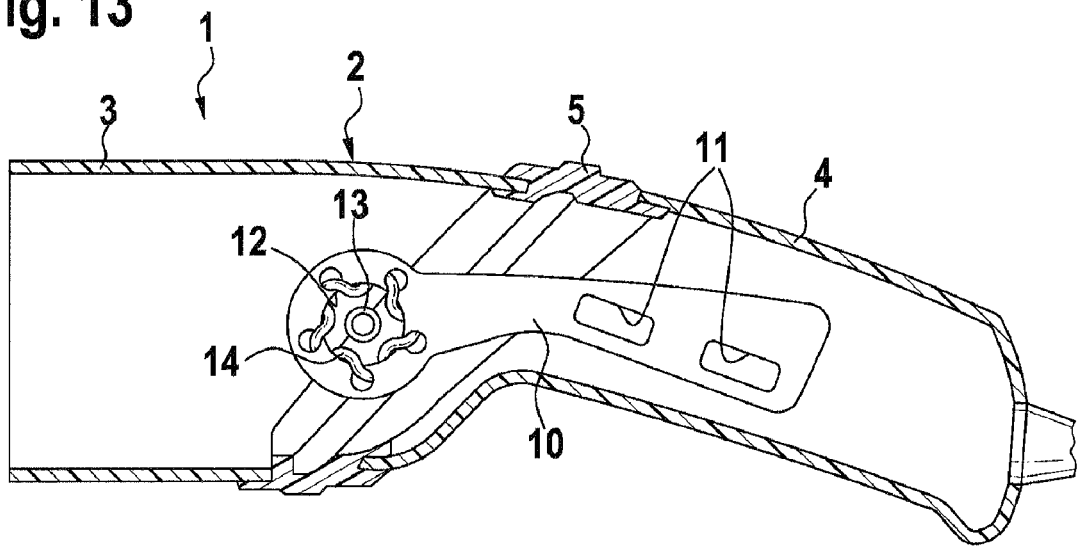
Figure 14:
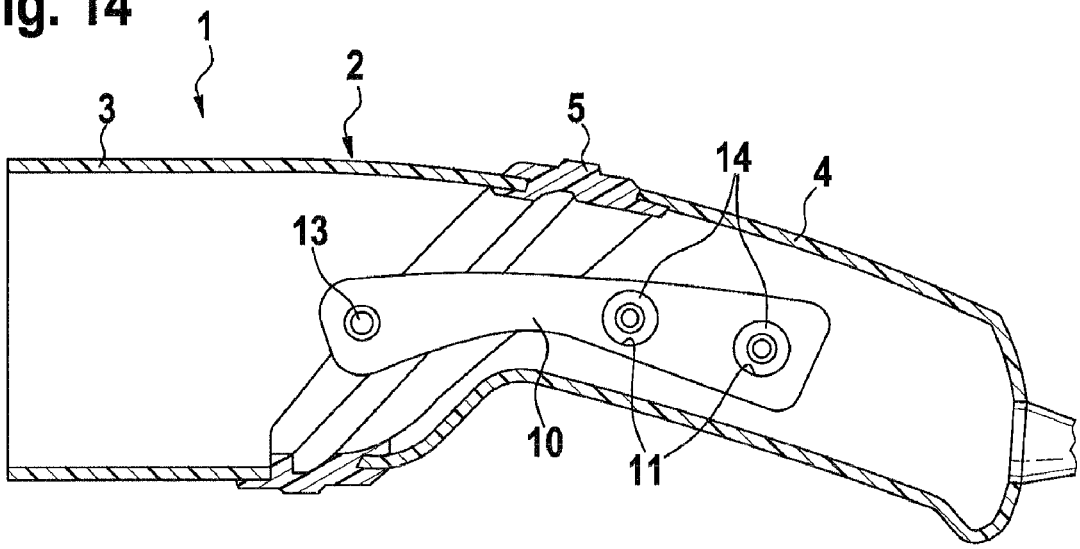
Figure 15:
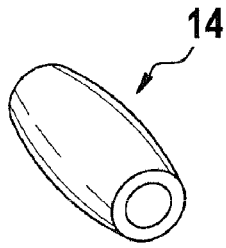
Figure 16:
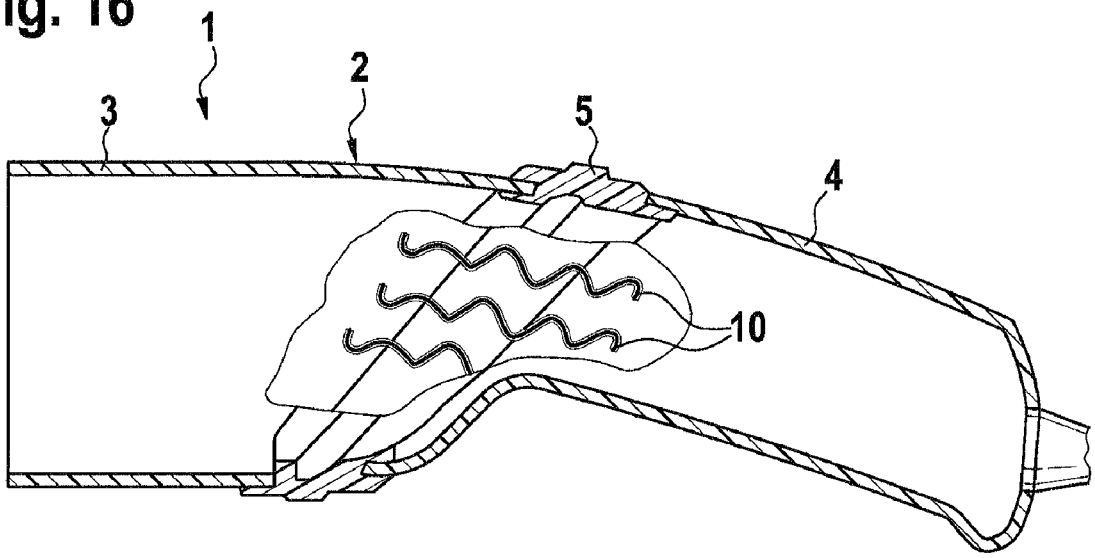

FIG. 12 shows a further embodiment in which the connection between the securing part and the front housing part is realized using a plurality of damping rings, FIG. 13 shows a further design, in which the secondary damping element on the securing part is designed as an elastomer band, FIG. 14 shows a further embodiment, in which the secondary damping element is located between the securing part and the rear housing part, and is designed as a preloaded tube element, as depicted in FIG. 15, FIG. 15 shows a perspective, isolated view of the secondary damping element used in the embodiment presented in FIG. 14, FIG. 16 shows a further embodiment, in which the secondary damping element is designed as shaped fibers or coil springs.

Components that are the same are labelled using the same reference numerals in the figures.

Hand-held power tool 1 depicted in FIG. 1, e.g., an electrically driven angle grinder, includes a multiple-component housing 2 composed of a front, shell-shaped housing part 3 which forms a motor housing, and a rear, shell-shaped housing part 4 that forms a handle housing 4. A gearbox housing 19, which abuts front housing part 3, is also assigned to housing 2. Housing parts 3 and 4 are interconnected via a primary damping element 5 which performs a force-transferring function, holds housing parts 3 and 4 together, and dampens vibrations. As the drive unit, an electrical drive motor 6 is provided in motor housing 2, and drives—as indicated merely symbolically—a drive shaft 8 in gearbox housing 19, a tool 9 being detachably fastened to drive shaft 8. An electronics unit 20 for performing closed-loop control and open-loop control of the drive motor is located in rear housing part 4.

Furthermore, a securing part 10 is provided in the interior of the housing, which is situated such that it acts in parallel with primary damping element 5 and connects housing parts 3 and 4 to one another. Securing part 10 extends over primary damping element 5 which bridges a gap that separates housing parts 3 and 4. Securing part 10 is connected in a form-fit manner to rear housing part 4; to this end, form-fit recesses 11 are formed in securing part 10, and are placed on corresponding form-fit raised areas formed on rear housing part 4. In the front region facing front housing part 3, securing part 10 includes a recess 12 into which a bolt 13 formed as a single piece with front housing part 3 extends. A secondary damping element 14, which is composed, e.g., of a soft damping material, is located between the inner jacket of recess 12 and bolt 13. Secondary damping element 14 may be connected to securing part 10 and/or to bolt 13.

It is essential that the main component of the forces between front and rear housing parts 3 and 4, respectively, be transferred via primary damping element 5 during regular operation and while primary damping element functions properly. Securing part 10 and secondary damping element 14 become operational only if the primary damping element fails, or if high forces are present that act on hand-held power tool 1, e.g., impacts on the housing, and if relative displacement that exceeds a threshold value occurs between the front and rear housing parts. During regular operation, no forces or only minimal forces are transferred via securing part 10 and secondary damping element 14 between housing parts 3, 4. Forces are transferred via securing part 10, and, simultaneously, damping occurs via secondary damping element 14 only if the aforementioned relative displacement that occurs between the housing parts exceeds a threshold value and, therefore, if secondary damping element 14 between securing part 10 and bolt 13 on front housing part 13 becomes deformed.

As shown in FIGS. 2 and 3, secondary damping element 14 is designed as a damping ring located in the intermediate space between the outer jacket of bolt 13 and the inner wall of recess 12 in securing part 10. Secondary damping element 14 is composed of two concentric rings having different diameters, and which are interconnected via radially extending segments, and between which a plurality of chambers is formed, the chambers being separated by the segments and being distributed around the circumference. Secondary damping element 14 is advantageously retained on the wall of the securing part that borders recess 12. The inner ring of secondary damping element 14 bears with contact against jacket surface of bolt 13.

In the embodiment shown in FIG. 4, secondary damping element 14 is likewise annular in design. It includes a central recess bounded by inwardly directed nubs or teeth of the secondary damping element. Bolt 13 extends into this central recess, and the bolt and secondary damping element are positioned relative to one another such that the jacket surface of the bolt bears with contact against the inwardly directed nubs, or, according to a further embodiment, such that an air gap is present between the nubs and the bolt.

The embodiment depicted in FIG. 5 largely corresponds to that shown in FIG. 1, and so reference is made to the discussion there with regard for the matching design. In contrast to FIG. 1, however, in the case of FIG. 5, the outer diameter of secondary damping element 14 is smaller than the inner diameter of recess 12 in securing part 10, and so an air gap exists between the secondary damping element and the inner side of the recess. Secondary damping element 14 is slid onto bolt 13.

Furthermore, it may be advantageous to provide a securing part on the left-hand side of the inner housing region, and on the right-hand side of the inner housing region. A secondary damping element is assigned to each securing part, it being possible to provide a common secondary damping element for both lateral securing parts; this common secondary damping element extends in the transverse direction across the width of the housing.

Secondary damping element 14 shown in FIG. 6 includes a central recess for sliding onto a bolt, and includes radially inwardly directed teeth or nubs.

In the embodiment presented in FIG. 7, an additional, foamed secondary damping element 15 is inserted into each form-fit recess 11 in the rear region of securing part 10, via which the connection to rear housing part 4 is established; foamed secondary damping part 15 is composed, e.g., of a PU foam. Via these secondary damping elements, effective damping is likewise attained between the housing parts, which becomes effective only if the primary damping element fails. Secondary damping element 14 located in the front region may also be provided, or this front secondary damping element may be eliminated.

In the embodiment depicted in FIG. 8, a section **10*a* of securing part 10 is designed in terms of structure and/or geometry such that, if relative displacement occurs in the longitudinal direction between housing parts 3 and 4, securing part 10 may expand or contract in section 10*a*. As shown in FIG. 9, this is attained, e.g., in that the material of securing part 10 is designed in the shape of a wave or bellows in section 10*a*, and so minimal forces are required in this region to attain extension or contraction. As furthermore shown in FIG. 8, a recess is also advantageously provided in region 10*a* in order to further weaken the securing part at this point. Section 10*a* of the securing part performs the function of a secondary damping element. Vibrations that act in the longitudinal direction of the hand-held power tool cause expansion or contraction to occur in section 10*a***, and additional damping is attained via the inherent damping of the material of which the securing part is composed.

In the embodiment presented in FIG. 10, securing part 10 is designed as a steel band or a steel cable onto which a tube 16 has been drawn, tube 16 performing the function of the secondary damping element. Securing part 10, including tube 16, is designed to be deformable. In order to be secured in the housing, securing part 10 is wrapped around two raised areas 17 in front housing part 3, and it is fastened to a projection 18 in rear housing part 4.

In the embodiment shown in FIG. 11, the securing part is likewise designed as a steel cable onto which a tube 16 has been drawn. Tube 16 is not freely deformable, however, but rather is designed to be substantially self-supporting. Any shapes or geometries may be specified for the tube and the wire cable; if tube 16 has a wavy shape, additional expansion or contraction path may occur, which is used to dampen vibrations.

In the embodiment shown in FIG. 12, a total of four annular secondary damping elements 14 is provided, which are effective between securing part 10 and bolt 13 on second, front housing part 3. Four secondary damping elements 14 enclose bolt 13, which is located on front housing part 3, in an annular manner. Instead of the annular secondary damping elements, it is also possible, e.g., to use a cable or a suitably shaped injection-molded part. The damping elements may be positioned in a regular or irregular manner.

In the embodiment shown in FIG. 13, secondary damping element 14 is likewise located in recess 12 in securing part 10, and it encloses bolt 13 in an annular manner. Secondary damping element 14 is designed as an elastomer band which is guided along the inner wall of recess 12 and through bores formed in the wall that bounds recess 12.

In the embodiment presented in FIG. 14, secondary damping elements 14 that are designed in the manner depicted in FIG. 15 are inserted in every recess 11 in the rear region of securing part 10. Every secondary damping element 14 has a tubular shape and is contracted axially in order to form a bulge, thereby attaining preload and influencing the damping properties.

In the embodiment shown in FIG. 16, a plurality of individual securing parts 10 is provided, which are designed, e.g., as carbon fibers, shaped coiled springs or wire cables, and which are fastened directly to housing parts 3 and 4. Securing parts 10 may also be enclosed in a coating of the material of which primary damping element 5 is composed. Securing parts 10 also have vibration-damping properties which are attained via the geometry of the securing parts. Securing parts 10 have expansion properties when they are designed, in particular, as coiled springs or a bellows-shaped, wavy component, thereby enabling damping to occur via the inherent damping property of the material.

What is claimed is:

1. An electrically driven hand-held power tool (1), comprising a drive unit, which is located in a housing (2) and has a drive connection (7) to a tool (9), wherein the housing (2) includes two separate housing parts (3, 4), between which a primary damping element (5) is situated, wherein a secondary damping element (14), which functions in parallel with the primary damping element (5), is situated between the two housing parts (3, 4) and interacts with a securing part (10) that bridges the two housing parts (3, 4), wherein the securing part (10) is fixedly connected to one housing part (4), and it is loosely connected to the other housing part (3) via the secondary damping element (14), wherein during regular functioning of the primary damping element (5), the secondary damping element (14) is at least approximately force-free, and, if the primary damping element (5) becomes deformed beyond a defined extent and, therefore, the relative position between the housing parts (3, 4) changes, damping is performed by the secondary damping element (14), and wherein the securing part (10) is designed as wire cable, and the secondary damping part (14) is designed as a tube (16) drawn over the wire cable.

2. The hand-held power tool as recited in claim 1, wherein the securing part (14) is connected via a bolt-receptacle-connection device to one housing part (13), and the secondary damping element (14) at least partially encloses the bolt (13).

3. The hand-held power tool as recited in claim 1, wherein a common secondary damping element (14) is provided for two securing parts (10) situated in the left-hand and right-hand regions of the hand-held power tool (1).

4. The hand-held power tool as recited in claim 1, wherein the secondary damping element (14) is designed as a standalone component and is located on the securing part (10).

5. The hand-held power tool as recited in claim 1, wherein the secondary damping element (14) is integrated in the securing part (10).

6. The hand-held power tool as recited in claim 5, wherein the secondary damping element (14) is designed as a single piece with the securing part (10).

7. The hand-held power tool as recited in claim 5, wherein the secondary damping element (14) is designed as wire cable, carbon fiber or coiled spring, which is incorporated in the material of the securing part (10).

8. The hand-held power tool as recited in claim 1, wherein, during regular operation, an air gap is present between the secondary damping element (14) and a component of the housing part (3, 4) to be connected.

9. The hand-held power tool as recited in claim 1, wherein, during regular operation, the secondary damping element (14) bears with contact against a component of the housing part (3, 4) to be connected.

10. The hand-held power tool as recited in claim 1, wherein the secondary damping element (14) is composed of damping material such as an elastomer.

11. The hand-held power tool as recited in claim 1, wherein the secondary damping element (14) contains a weave composed, e.g., of metal and/or plastic, as the damping material.

12. The hand-held power tool as recited in claim 1, wherein the secondary damping element (14) contains a fluid or hydraulic medium as the damping material.

* * * * *